US009540146B2

(12) United States Patent
Chaturvedi

(10) Patent No.: US 9,540,146 B2
(45) Date of Patent: Jan. 10, 2017

(54) TAMPER EVIDENT STRUCTURE, METHOD FOR MAKING SUCH A STRUCTURE, AND TAMPER EVIDENT PACKAGE COMPRISING SUCH A STRUCTURE

(76) Inventor: Ashok Chaturvedi, New Delhi (IN)

( * ) Notice: Subject to any disclaimer, the term of this patent is extended or adjusted under 35 U.S.C. 154(b) by 0 days.

(21) Appl. No.: 13/505,773

(22) PCT Filed: Mar. 8, 2011

(86) PCT No.: PCT/IN2011/000149
§ 371 (c)(1),
(2), (4) Date: May 3, 2012

(87) PCT Pub. No.: WO2011/111062
PCT Pub. Date: Sep. 15, 2011

(65) Prior Publication Data

US 2012/0219240 A1 Aug. 30, 2012

(30) Foreign Application Priority Data

Mar. 9, 2010 (IN) ..... 540/DEL/2010

(51) Int. Cl.
*B65D 33/14* (2006.01)
*B65D 33/25* (2006.01)

(52) U.S. Cl.
CPC ..... *B65D 33/2591* (2013.01); *Y10T 24/2514* (2015.01); *Y10T 24/2532* (2015.01)

(58) Field of Classification Search
CPC ..... B65D 33/2533
(Continued)

(56) References Cited

U.S. PATENT DOCUMENTS 4,354,541 A * 10/1982 Tilman ..... B29C 66/1122 156/291
5,216,787 A * 6/1993 Custer et al. ..... 24/585.12
(Continued)

FOREIGN PATENT DOCUMENTS

GB 2396660 A * 6/2004 ..... B65D 51/00
JP 2003053860 A * 2/2003 ..... B31B 1/90
(Continued)

OTHER PUBLICATIONS

Machine translation of Japanese Document No. 2003-53860. Translated on Nov. 21, 2014.*

*Primary Examiner* — Jes F Pascua
(74) *Attorney, Agent, or Firm* — Law Offices of Steven W. Weinrieb

(57) ABSTRACT

A tamper evident structure (10) for flexible packages is disclosed to include a slider-zipper assembly (100) and a tamper evident diaphragm (200). The slider-zipper assembly includes a slider (102) engaged with a zipper (104). The zipper includes a longitudinal male element (106) engageable to a longitudinal female element (108), a first flap (114) and a second flap (116) extending downwardly along the respective length from the longitudinal male and the longitudinal female element. Further, the tamper evident diaphragm includes a plurality of temperature sensitive ribs (202) configured along the length on an outer surface thereof, and a pressure sensitive weak line (204) configured centrally along the length of the tamper evident diaphragm. The tamper evident diaphragm is sealed to the zipper in such a manner that a first end portion and a second end portion of the tamper evident diaphragm is respectively sealed to the first flap and the second flap, forming the tamper evident structure for the flexible packages.

14 Claims, 7 Drawing Sheets

(58) Field of Classification Search
USPC ..... 383/64, 61.2, 5, 63, 203; 24/399, 400, 24/585.12, DIG. 38–DIG. 41
See application file for complete search history.

(56) References Cited

U.S. PATENT DOCUMENTS

| | | | | |
|---|---|---|---|---|
| 5,242,516 | A * | 9/1993 | Custer et al. | 156/66 |
| 5,638,586 | A * | 6/1997 | Malin et al. | 24/585.12 |
| 5,660,479 | A * | 8/1997 | May et al. | 383/204 |
| 5,725,312 | A * | 3/1998 | May | 383/210 |
| 5,887,980 | A * | 3/1999 | May | 383/204 |
| 5,893,645 | A * | 4/1999 | May | 383/208 |
| 5,904,425 | A * | 5/1999 | May | 383/203 |
| 6,071,011 | A * | 6/2000 | Thomas et al. | 383/64 |
| 6,154,934 | A * | 12/2000 | Matthews | 24/585.1 |
| 6,378,177 | B1 * | 4/2002 | Athans et al. | 24/585.12 |
| 6,481,890 | B1 * | 11/2002 | VandenHeuvel | B65D 33/2591 156/66 |
| 6,499,878 | B1 * | 12/2002 | Dobreski et al. | 383/5 |
| 7,185,403 | B2 * | 3/2007 | Chaturvedi | 24/585.12 |
| 7,254,873 | B2 * | 8/2007 | Stolmeier et al. | 24/400 |
| 7,416,336 | B2 * | 8/2008 | Linton et al. | 383/5 |
| 7,540,072 | B2 * | 6/2009 | Anzini et al. | 24/399 |
| 8,083,660 | B2 * | 12/2011 | Chaturvedi | 493/213 |
| 2004/0123433 | A1 * | 7/2004 | Chaturvedi | B65D 33/2591 24/400 |
| 2004/0131283 | A1 * | 7/2004 | Sprague et al. | 383/61.2 |
| 2005/0157959 | A1 * | 7/2005 | Johnson | B31B 19/90 383/61.2 |
| 2005/0188511 | A1 * | 9/2005 | Chaturvedi | 24/400 |
| 2007/0274612 | A1 * | 11/2007 | Chaturvedi | 383/10 |
| 2008/0118189 | A1 * | 5/2008 | Johnson | B31B 19/90 383/64 |

FOREIGN PATENT DOCUMENTS

| | | |
|---|---|---|
| WO | WO0200520 | 1/2002 |
| WO | WO 2005113357 | 12/2005 |
| WO | WO 2009016644 | 2/2009 |

* cited by examiner

TAMPER EVIDENT STRUCTURE, METHOD FOR MAKING SUCH A STRUCTURE, AND TAMPER EVIDENT PACKAGE COMPRISING SUCH A STRUCTURE

FIELD OF THE DISCLOSURE

The present disclosure generally relates to tamper evident structures for flexible packages and more particularly, to a tamper evident structures facilitating effective sealing thereof with flexible packages.

BACKGROUND OF THE DISCLOSURE

Tamper evident flexible packages are commonly used in packaging industries to match the demands of consumers' satisfaction. More often than not, in view of providing tamper evidence to the flexible packages, tamper evident structures are configured to the flexible packages. However, in various instances while configuring the tamper evident structures to the flexible packages, the tamper evident structures get tampered due to heat and pressure, which are required to configure the tamper evident structures to the flexible packages. For example: a tamper evident structure including a slider-zipper assembly having a closed loop extending from the zipper gets tampered due to heat and pressure. Specifically, such tamper evident structure may be configured to the flexible packages by sealing the closed loops to opposite side panels of the flexible packages in such a manner that when the slider-zipper assembly is opened, users have to tear the closed loop to access contents of the flexible packages. However, while configuring the closed loop of such tamper evident structure to the flexible packages, the closed loop may get sealed to itself due to heat and pressure, in turn tampering the tamper evident structures. Particularly, in case of flexible package when product filling is done from the top side of the package and then the loop is sealed with remaining side of the panel of the package by pressure and heat.

Accordingly, there exists a need to prevent tampering of the tamper evident structures while configuring thereto with the flexible packages.

SUMMARY OF THE DISCLOSURE

In view of the foregoing disadvantages inherent in the prior-art, the general purpose of the present disclosure is to provide tamper evident structure for flexible packages, that is configured to include all advantages of the prior art and to overcome the drawbacks inherent in the prior art offering some added advantages.

An object of the present disclosure is to prevent tampering of the tamper evident structure while configuring thereto with anyone or both panel(s) of the flexible package after filling or while fabricating of empty package.

To achieve the above objective, in an aspect of the present disclosure, a tamper evident structure for flexible packages is provided. The tamper evident structure includes a press to lock zipper or a slider-zipper assembly and a tamper evident diaphragm. The slider-zipper assembly includes a slider adapted to engage with a zipper to close and open the zipper. The zipper includes a longitudinal male element and a longitudinal female element engageable to each other. The zipper further includes a first flap extending downwardly along the length from the longitudinal male element; and a second flap extending downwardly along the length from the longitudinal female element. Further, the tamper evident diaphragm includes a plurality of temperature sensitive ribs configured along the length on an outer surface thereof. The tamper evident diaphragm is sealed to the zipper from an inner surface thereof in such a manner that a first end portion of the tamper evident diaphragm is sealed to outside of the first flap and a second end portion of the tamper evident diaphragm is sealed to outside of the second flap, thereby forming the tamper evident structure for the flexible packages.

In one form, the tamper evident diaphragm from its first end portion is sealed to at least two sealing portions along the length of the first flap such that the two sealing portions are spaced apart from each other with a gap. Similarly, the second end portion of the tamper evident diaphragm is also sealed to at least second sealing portions along the length of the second flap such that the two sealing portions are spaced apart from each other with a gap. The gaps facilitate in substantially inhibiting the flow of heat across the first flap and the second flap while sealing the tamper evident diaphragm to package panels.

In other aspects of the present disclosure, a method for forming the tamper evident structure as disclosed earlier and a tamper evident flexible package having the tamper evident structure are also provided.

The method for making the tamper evident structure includes forming of the slider-zipper assembly. Further, forming the tamper evident diaphragm as described above. Furthermore, sealing the tamper evident diaphragm (200) and the slider-zipper assembly with each other in a manner as described above.

Moreover, the tamper evident flexible package includes a pair of opposite panels coupled to configure a pocket having three closed sides and a top open side. Further, the package includes a tamper evident structure, as described above, sealed to at least one panel of the pair of opposite panels proximate to the top open side.

These together with the other aspects of the present disclosure, along with the various features of novelty that characterize the present disclosure, are pointed out with particularity in the description, along with the abovementioned summary, annexed hereto and form a part of the present disclosure. For a better understanding of the present disclosure, its operating advantages and the specified object attained by its uses, reference should be made to the accompanying drawings and descriptive matter in which there are illustrated exemplary embodiments of the present disclosure.

BRIEF DESCRIPTION OF THE DRAWINGS

The advantages and features of the present disclosure shall be better understood with reference to the following detailed description taken in conjunction with the accompanying drawing, wherein like elements are identified with like symbols and in which.

Like reference numerals refer to like parts throughout the description of several views of the drawings.

DETAILED DESCRIPTION OF THE DISCLOSURE

For a thorough understanding of the present disclosure, reference is to be made to the following detailed description in connection with the abovementioned drawings. Although the present disclosure is described in connection with exemplary embodiments, the present disclosure is not intended to be limited to the specific forms set forth herein. It is understood that various omissions and substitutions of equivalents are contemplated as circumstances may suggest or render expedient, but these are intended to cover the application or implementation without departing from the spirit or scope of the present disclosure. Further, it will nevertheless be understood that no limitation in the scope of the disclosure is thereby intended, such alterations and further modifications in the figures and such further applications of the principles of the disclosure as illustrated therein being contemplated as would normally occur to one skilled in the art to which the disclosure relates. Also, it is to be understood that the phraseology and terminology used herein is for the purpose of description and should not be regarded as limiting. Further, reference herein to "one embodiment" or "an embodiment" means that a particular feature, characteristic, or function described in connection with the embodiment is included in at least one embodiment of the disclosure. Furthermore, the appearances of such phrase at various places herein are not necessarily all referring to the same embodiment. The terms "a" and "an" herein do not denote a limitation of quantity, but rather denote the presence of at least one, of the referenced item.

Figure 1A:
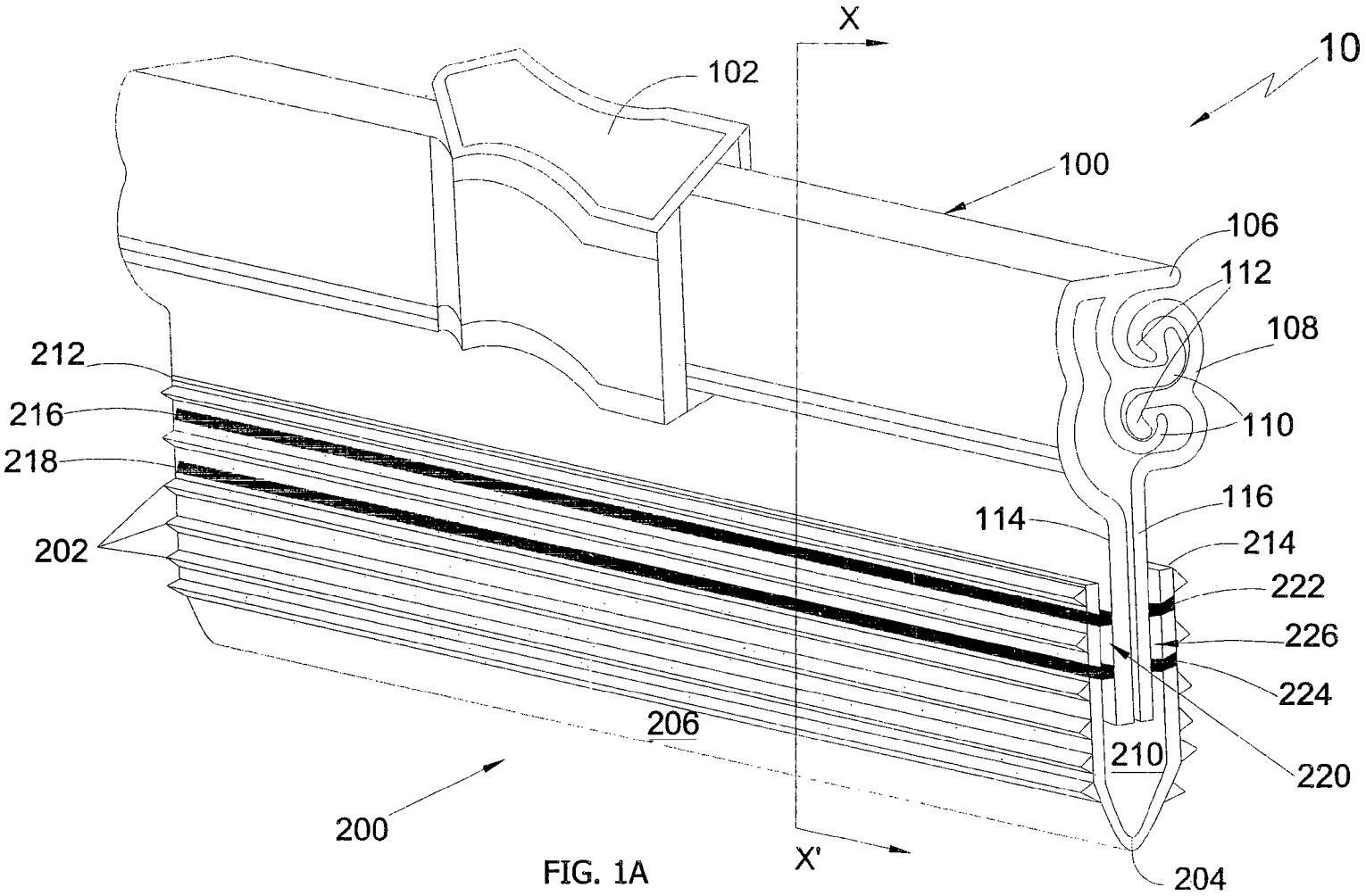
FIG. 1A illustrates a perspective view of a tamper evident structure, in accordance with an exemplary embodiment of the present disclosure.
Figure 1B:
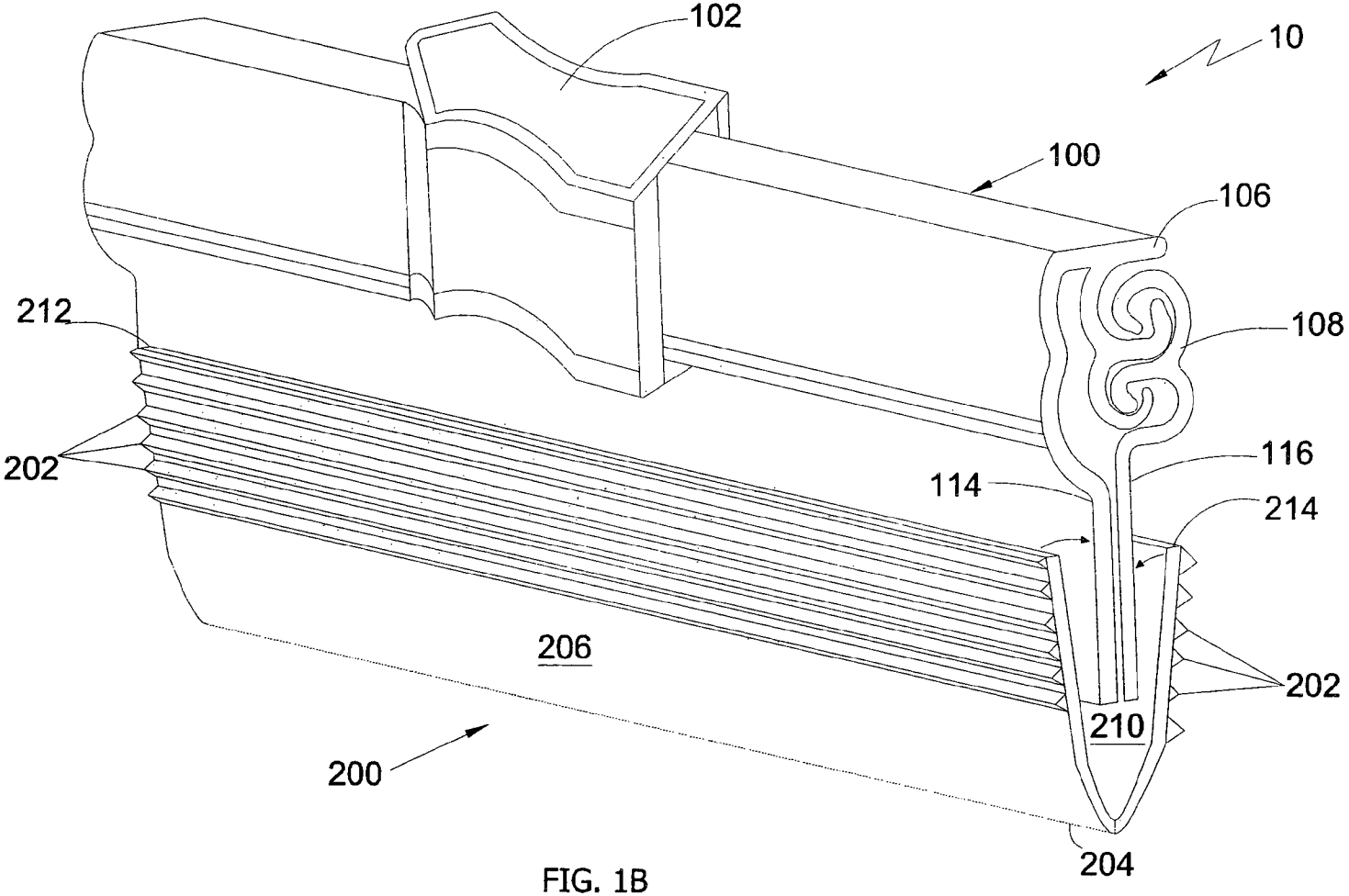
FIG. 1B illustrates an exploded view of the tamper evident structure, in accordance with an exemplary embodiment of the present disclosure.
Figure 1C:
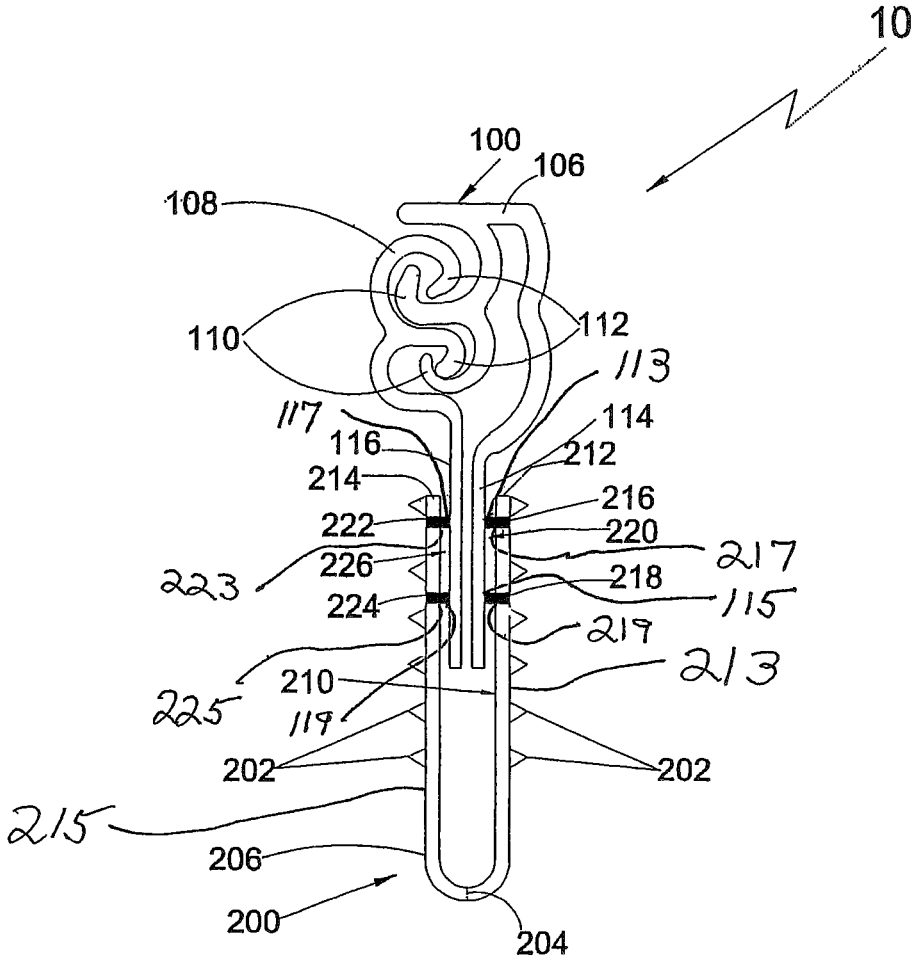
FIG. 1C illustrates a cross sectional view of the temper evident structure of FIG. 1A along axis XX', in accordance with an exemplary embodiment of the present disclosure.

Referring to FIGS. 1A to 1C, various views of a tamper evident structure (10), in accordance with exemplary embodiments of the present disclosure are illustrated. Specifically, FIG. 1A illustrates a perspective view of the tamper evident structure (10) and FIG. 1B illustrates an exploded view of the tamper evident structure (10). Further, FIG. 1C illustrates a cross sectional view of the tamper evident structure (10) of FIG. 1A along axis XX'. The tamper evident structure (10) is made of polymers. The polymers from which the tamper evident structure (10) may be made include, but not limited to, Polypropylene, Polystyrene, Polyester, Polyethylene, Delrine, Nylon and Acrylonitrile Butadiene Styrene (ABS) and combination thereof.

The tamper evident structure (10) includes a slider-zipper assembly (100) and a tamper evident diaphragm (200). The slider-zipper assembly (100) includes a slider (102) adapted to engage with a zipper (104) to close and open the zipper (104). However without departing from the scope of the present disclosure, the tamper evident structure (10) may include zipper without slider which may be press locked. The zipper (104) includes a longitudinal male element (106) and a longitudinal female element (108) engageable to the longitudinal male element (106). In one form, the longitudinal male element (106) includes at least one pair of notches (110) configured along its length to engage with a complementary pair of notches (112) configured along the length of the longitudinal female element (108). Further, the zipper (104) includes a first flap (114) extending downwardly along the length from the longitudinal male element (106); and a second flap (116) extending downwardly along the length from the longitudinal female element (108).

Furthermore, the tamper evident diaphragm (200) of the tamper evident structure (10) includes a plurality of temperature sensitive ribs (202) and a pressure sensitive weak line (204). The plurality of temperature sensitive ribs (202) is configured along the length on an outer surface (206) of the tamper evident diaphragm (200). Further, the pressure sensitive weak line (204) is configured centrally along the length of the tamper evident diaphragm (200). The pressure sensitive weak line (204) may be configured on the tamper evident diaphragm (200) while extrusion manufacturing by designing a mould that include a lower thickness area at a central portion thereof. The pressure sensitive weak line (204) may also be provided on the tamper evident diaphragm (200) after manufacturing thereof by leaser technology. However, without departing from the scope of the present invention the pressure sensitive weak line (204) may be provided by any other method know in the art.

The tamper evident diaphragm (200) is sealed to the slider-zipper assembly (100) in order to configure the tamper evident structure (10). In one form, the tamper evident diaphragm (200) is sealed to the zipper (104) from an inner surface (210) thereof in such a manner that a first end portion (212) of the tamper evident diaphragm (200) is sealed to the first flap (114) and a second end portion (214) of the tamper evident diaphragm (200), is sealed to the second flap (116). Such sealing between the tamper evident diaphragm (200) and the slider-zipper assembly (100) forms the tamper evident structure (10).

In one form, as clearly shown in FIG. 1C, the tamper evident diaphragm (200) from its first end portion (212) is sealed to at least two sealing portions, such as sealing portions (216) and (218) along the length of the first flap (114) such that the two sealing portions (216) and (218) are vertically spaced apart from each other with a first gap (220). The two sealing portions (216) and (218) are separate and distinct from the first end portion (212) and the first flap (114) of the male element (106), and it is seen that the first sealing portions (216,218) extend across the first gap (220) from inner surface portions (217,219) of the first end portion (212) of the tamper evident diaphragm (200) to outer surface portions (113, 115) of the first flap (114) of the longitudinal male element (106). Similarly, the second end portion (214) of the tamper evident diaphragm (200) is also sealed to at least two sealing portions, such as sealing portions (222) and (224) along the length of the second flap (116) such that the sealing portions (222) and (224) are vertically spaced apart from each other with a second gap (226). The two sealing portions (222) and (224) are separate and distinct from the second end portion (214) and the second flap (116) of the female element (108), and it is seen that the second sealing portions (222,224) extend across the second gap (226) from inner surface portions (223,225) of the second end portion (214) of the tamper evident diaphragm (200) to outer surface portions (117,119) of the second flap (116) of the longitudinal female element (108). The first gap (220) and the second gap (226) are capable of substantially inhibiting the flow of heat across the first gap (220) and the second gap (226) to the first flap (114) and the second flap (116) when first and second panel members of a package are sealed to outer surface portions (213) and (215) of the first and second end portions (212, 214) of the tamper evident diaphragm (200) as will be more fully described in conjunction with FIGS. 3A and 3B. It is also seen, as can be appreciated from FIG. 1C, that the first and second sealing portions (216, 218, 22, 224) are disposed at vertical elevations upon the first and second end portions (212,214) of the tamper evident diaphragm (200) so as to be interposed between consecutive ones of the plurality of vertically spaced temperature sensitive ribs (202) disposed upon the first and second end portions (212,214) of the tamper evident diaphragm (200). Further, the term "seal" and various forms thereof used herein may not be considered to be limited only to normal sealing techniques, but should be considered to cover the scope of various sealing techniques, such as a heat sealing technique, an ultrasonic sealing technique, a high frequency sealing technique, a hot melt sealing technique and sealing through welding techniques as known in the art that may be suitable for joining the tamper evident diaphragm (200) and the slider-zipper assembly (100) which forms the tamper evident structure (10).

Figure 2:
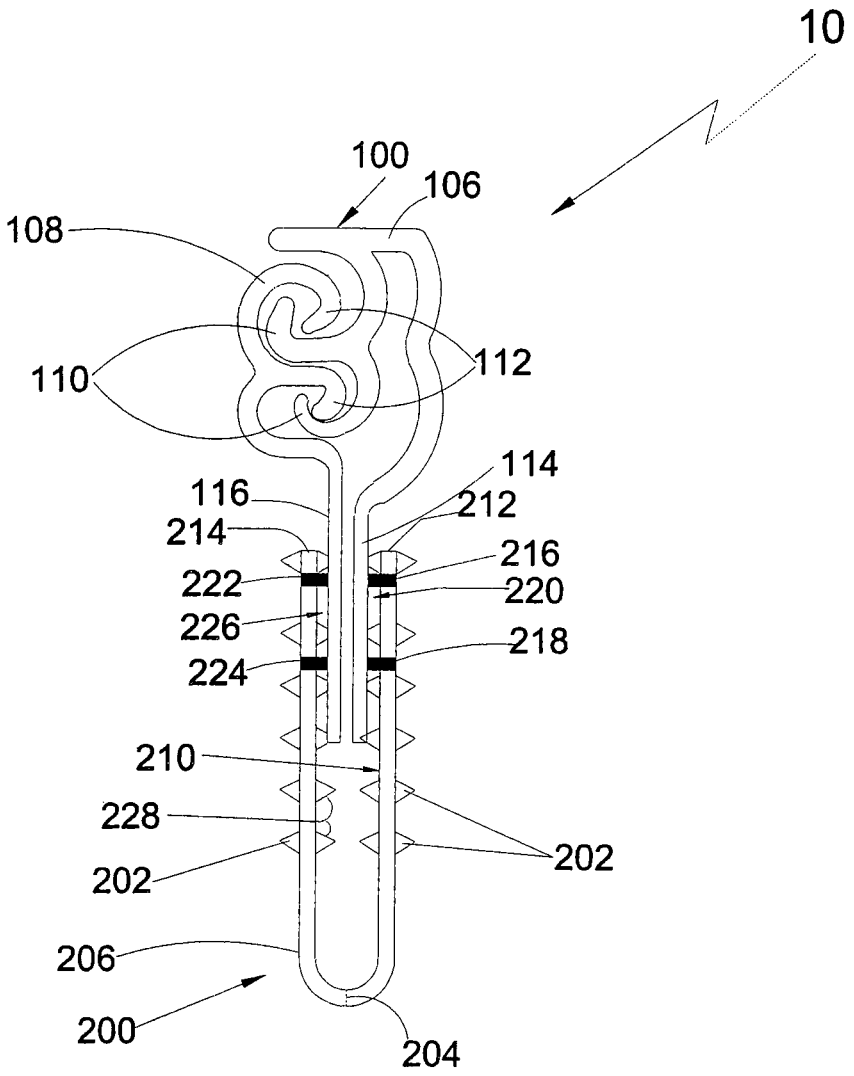
FIG. 2 illustrates a cross sectional view of a tamper evident structure, in accordance with another exemplary embodiment of the present disclosure.

In one embodiment of the present disclosure, apart from heat insulation features: the first and the second gaps (220) and (226), the tamper evident diaphragm (200) may further include a plurality of projections (228) configured along the length on the inner surface (210) thereof. An exemplary depiction of the plurality of projections (228) is shown in FIG. 2. The plurality of projections (228) is capable maintaining a separation between the folded inner surfaces (210) of the tamper evident diaphragm (200).

In one form, the tamper evident diaphragm (200) may be comprised of single polymeric layer having sealability to the outside of the first flap (114) and the second flap (116) of the zipper profile (100). In another form, the tamper evident diaphragm (200) may be comprised of co-extruded multi polymeric layers having sealability to the outside the first flap (114) and the second flap (116) of the zipper profile (100). Without departing from the scope of the present disclosure, the tamper evident diaphragm (200) may be formed by any other material or method as per requirement.

Figure 3A:
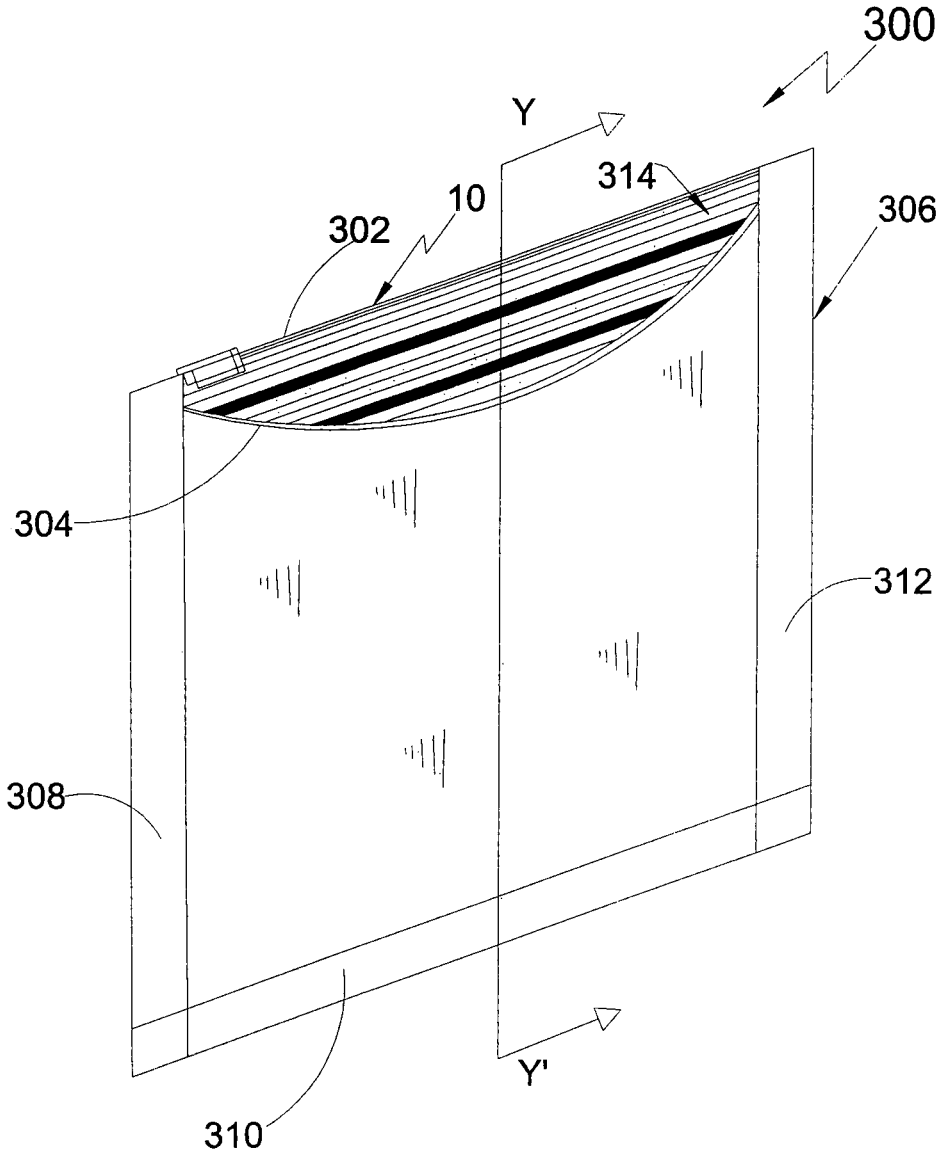
FIG. 3A illustrates a perspective view a package configuring the tamper evident structure, in accordance with an exemplary embodiment of the present disclosure.
Figure 3B:
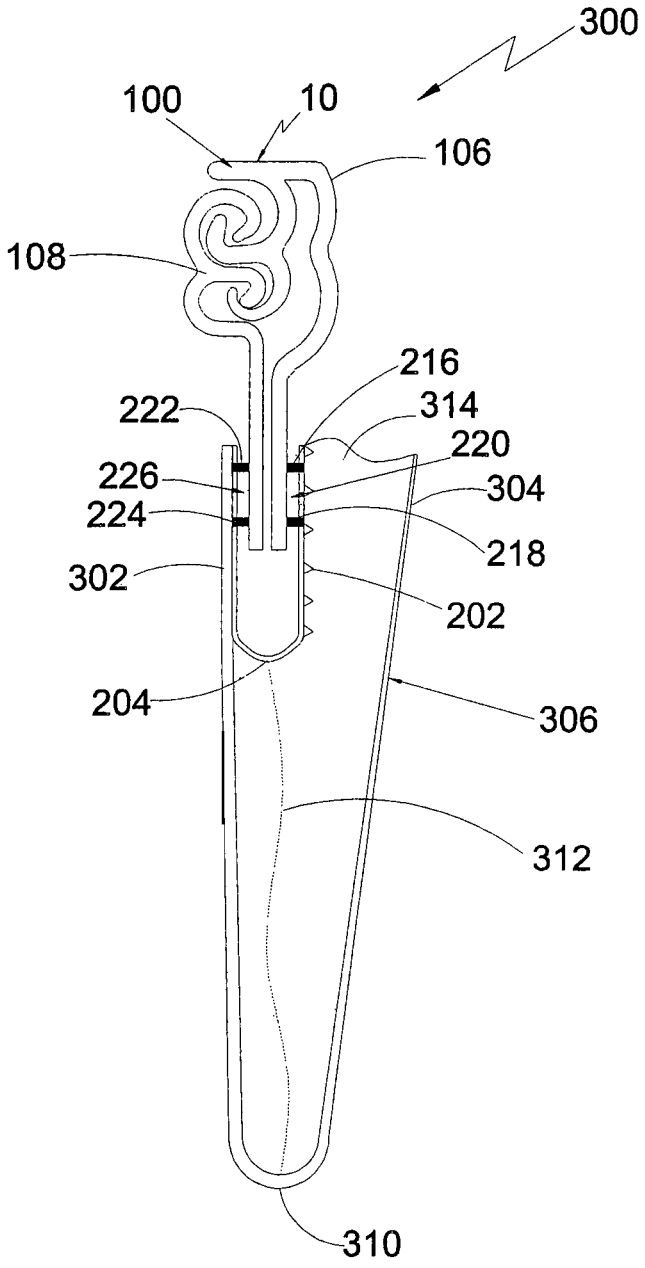
FIG. 3B illustrates a cross sectional view the package of FIG. 3A along axis YY', in accordance with an exemplary embodiment of the present disclosure.

Referring now to FIGS. 3A and 3B, a perspective view and a cross sectional side view of a tamper evident flexible package, hereinafter referred to as "package (300)," configuring the tamper evident structure (10) are respectively illustrated, in accordance with an exemplary embodiment of the present disclosure. Specifically, FIGS. 3A and 3B, depicts a utilized state of the tamper evident structure (10) with the package (300) and will be described in conjunction with FIGS. 1A to 2. The package (300) includes a pair of opposite panels (302) and (304) coupled to configure a pocket (306) having three closed sides (308), (310) and (312) and a top open side (314). The tamper evident structure (10) is sealed to at least one panel of the pair of opposite panels (302) and (304) proximate to the top open side (314). As shown in FIGS. 3A and 3B, the tamper evident structure (10) is sealed to the panel (302), and the panel (304) remains unsealed. The panel (304) may be sealed to the tamper evident structure (10) after filling the product through the top open side (314) of the pocket (306).

The panel (302) or (304) may be sealed to the tamper evident structure (10) via the plurality of temperature sensitive ribs (202). Specifically, in the sealing operation, when the heat is provided to the tamper evident structure (10) for sealing with the panel(s) (302) and/or (304), the plurality of temperature sensitive ribs (202) primarily melts to sealed with the panel (302) or (304), which reduce the exposure to direct heat and pressure on the tamper evident diaphragm (200), and the first flap (114) and the second flap (116) of the zipper profile (100). Further, to minimize the effect of transmission of the direct heat and pressure between the first flap (114) and the second flap (116), the respective gaps (220) and (226), configured thereon play an important role. For example, when the heat and pressure is provided for sealing the tamper evident structure (10) to the panel (302) or (304), the first gap (220) and the second gap (226) substantially inhibit the flow of heat across the first flap (114) and the second flap (116) while sealing the tamper evident structure (10) to the panel (302) or (304). Further, such gaps may also reduce the pressure effects onto the first flap (114) and the second flap (116) while sealing the tamper evident structure (10). Said plurality of temperature sensitive ribs (202) also results in effective sealing at lower temperature.

Further, in configurations, where the tamper evident diaphragm (200) includes the plurality of projections (228) (see FIG. 2) a suitable separation between the folded inner surface (210) of the tamper evident diaphragm (200), and between the first flap (114) and the second flap (116) is provided, which in turn provides further additional relaxation of direct heat and pressure. Further according to the industrial requirements, any suitable shape and size of the plurality of temperature sensitive ribs (202) and the plurality of projections (228) may be provided. Moreover, the pressure sensitive weak line (204) of the tamper evident diaphragm (200) is capable of being torn by finger pressure when, required in turn allowing accessibility to contents of the package (300).

Such precautionary measurements, the first and second gaps (220) and (226), the plurality of temperature sensitive ribs (202) and the plurality of projections (228), taken in relaxation of direct heat and pressure, prevents the heat and pressure applied on one side of the tamper evident diaphragm (200) from being transmitted to its inner surface side (210), and between the first flap (114) and the second flap (116), thereby preventing sealing there between, and providing the package (300), which has tamper proof specifications.

Figure 4:
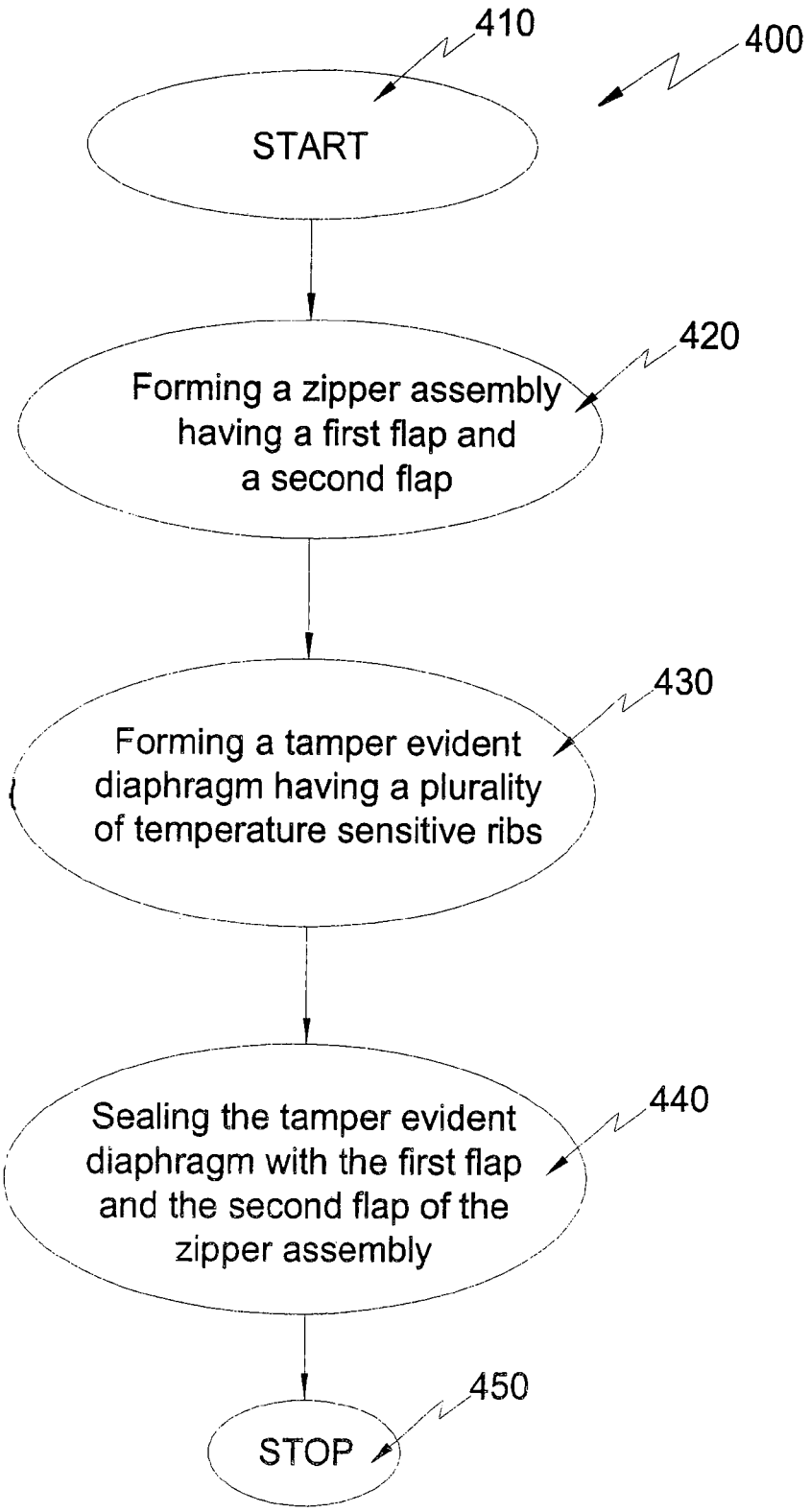
FIG. 4 illustrates a method for making the tamper evident structure, in accordance with an exemplary embodiment of the present disclosure.

Referring now to FIG. 4, a method (400) for making the tamper evident structure (10) is illustrated, in accordance with an exemplary embodiment of the present disclosure. The method starts, at (410). At (420), the slider-zipper assembly (100) is formed by the process known in the art. Further at (430), the tamper evident diaphragm (200) is formed as described above. Furthermore at (440), the tamper evident diaphragm (200) and the slider-zipper assembly (100) are sealed in a manner as described above. For the sake of brevity, the repetition of the text is precluded here. Moreover at (450), the method (400) stops.

The tamper evident structure (10) of the present disclosure offers following advantages. The tamper evident structure (10), specifically the first and second gaps (220) and (226), the plurality of temperature sensitive ribs (202) and the plurality of projections (228) prevents tempering of the tamper evident structure (10) while configuring thereto with the flexible packages by relaxing the heat and pressure transmission. Further, the tamper evident structure (10) is easy to manufacture.

The foregoing descriptions of specific embodiments of the present disclosure have been presented for purposes of illustration and description. They are not intended to be exhaustive or to limit the present disclosure to the precise forms disclosed and obviously many modifications and variations are possible in light of the above teaching. The embodiments were chosen and described in order to best explain the principles of the present disclosure and its practical application, to thereby enable others skilled in the art to best utilize the present disclosure and various embodiments with various modifications as are suited to the particular use contemplated. It is understood that various omission and substitutions of equivalents are contemplated as circumstance may suggest or render expedient, but such are intended to cover the application or implementation without departing from the spirit or scope of the present disclosure.

I claim:

1. A tamper evident structure for flexible packages, the tamper evident structure comprising:

a slider-zipper assembly having a slider adapted to engage with a zipper to close and open the zipper, wherein the zipper comprises a longitudinal male element (106), and a longitudinal female element (108) engageable with said longitudinal male element (106), a first flap (114) extending longitudinally, downwardly from, and along the length of said longitudinal male element (106), and a second flap (116) extending longitudinally, downwardly from, and along the length of said longitudinal female element (108); a tamper evident diaphragm (200) having a first end portion (212) adapted to be sealed with an outer surface portion of said first flap (114) of said longitudinal male element (106) of said zipper at two vertically spaced sealing areas by means of two vertically spaced first sealing portions (216,218) so as to provide a first gap (220) therebetween, said two vertically spaced first sealing portions (216, 218) being separate and distinct from said first end portion (212) of said tamper evident diaphragm (200) and said first flap (114) of said male element (106) and extending transversely across said first gap (220) from inner surface portions (217,219) of said first end portion (212) of said tamper evident diaphragm (200) to outer surface portions (113,115) of said first flap (114) of said longitudinal male element (106), wherein said first gap (220) is structured so as to effectively inhibit the flow of heat to said first flap (114) of said longitudinal male element (106) when a first panel member of the flexible package is sealed to an outer surface portion (213) of said first end portion (212) of said tamper evident diaphragm (200), a plurality of first vertically spaced temperature sensitive ribs (202) configured along the length of said outer surface portion (213) of said first end portion (212) of said tamper evident diaphragm (200) for sealing the first panel member of the flexible package to said tamper evident diaphragm (200), wherein said first vertically spaced temperature sensitive ribs (202) are structured to melt when heat is applied through the first panel member, and wherein said vertically spaced first sealing portions (216,218) are disposed at vertical elevations upon said first end portion (212) of said tamper evident diaphragm (200) so as to be interposed between consecutive ones of said plurality of first vertically spaced temperature sensitive ribs (202) disposed upon said first end portion (212) of said tamper evident diaphragm (200) and are structured to remain intact and maintain said first gap (220) after said first temperature sensitive ribs (202) melt; and a second end portion (214) adapted to be sealed with an outer surface portion (117) of said second flap (116) of said female element (108) of said zipper at two vertically spaced sealing areas by means of two vertically spaced second sealing portions (222,224) so as, to provide a second gap (226) therebetween, said two vertically spaced second sealing portions (222, 224) being separate and distinct from said second end portion (214) of said tamper evident diaphragm (200) and said second flap (116) of said fe-male element (108) and extending transversely across said second gap (226) from inner surface portions (223,225) of said second end portion (214) of said tamper evident diaphragm (200) to outer surface portions (117,119) of said second flap (116) of said female element (108), wherein said second gap (226) is structured so as to effectively inhibit the flow of heat to said second flap (116) of said female element (108) when a second panel member of the flexible package is sealed to an outer surface portion (215) of said second end portion (214) of said tamper evident diaphragm (200), and a plurality of vertically spaced second temperature sensitive ribs (202) configured along the length of said outer surface portion (215) of said second end portion (214) of said tamper evident diaphragm (200) for sealing the second panel member of the flexible package to said tamper evident diaphragm (200), wherein said plurality of vertically spaced second temperature sensitive ribs (202) are structured to melt when heat is applied through the second panel member, and wherein said vertically spaced second sealing portions (222, 224) are disposed at vertical elevations upon said second end portion (214) of said tamper evident diaphragm (200) so as to be interposed between consecutive ones of said plurality of second vertically spaced temperature sensitive ribs (202) and are structured to remain intact and maintain said second gap (226) after said second temperature sensitive ribs (202) melt.

2. The tamper evident structure as claimed in claim 1, the slider-zipper assembly and the tamper evident diaphragm are sealed to each other by at least one of a heat sealing technique, an ultrasonic sealing technique, a high frequency sealing technique and a hot melt sealing technique.

3. The tamper evident structure as claimed in claim 1, wherein the tamper evident diaphragm further comprises a plurality of projections configured along the length on the inner surface thereof, wherein the plurality of projections is capable of maintaining a separation between the folded inner surface of the tamper evident diaphragm.

4. The tamper evident structure as claimed in claim 1, wherein a pressure sensitive weak line configured centrally along the length of the tamper evident diaphragm for tearing thereto to access the flexible package to which the tamper evident structure is configured.

5. The tamper evident structure as claimed in claim 1, wherein the tamper evident diaphragm is comprised of single polymeric layer having sealability with the first flap and the second flap.

6. The tamper evident structure as claimed in claim 1, wherein the tamper evident diaphragm is comprised of co-extruded multi polymeric layers having sealability with the first flap and the second flap.

7. A method for forming a tamper evident structure for flexible packages, the method comprising:

forming a slider-zipper assembly having a slider adapted to engage with a zipper to close and open the zipper, wherein the zipper comprises a longitudinal male element (106), and a longitudinal female element (108) engageable with said longitudinal male element (106), a first flap (114) extending longitudinally, downwardly from, and along the length of said longitudinal male element (106), and a second flap (116) extending longitudinally, downwardly from, and along the length of said longitudinal female element (108); and forming a tamper evident diaphragm (200) having a first end portion (212) adapted to be sealed with an outer surface portion of said first flap (114) of said longitudinal male element (106) of said zipper at two vertically spaced sealing areas by means of two vertically spaced first sealing portions (216,218) so as to provide a first gap (220) therebetween, said two vertically spaced first sealing portions (216,218) being separate and distinct from said first end portion (212) of said tamper evident diaphragm (200) and said first flap (114) of said male element (106) and extending transversely across said first gap (220) from inner surface portions (217, 219) of said first end portion (212) of said tamper evident diaphragm (200) to outer surface portions (113, 115) of said first flap (114) of said longitudinal male element (106), wherein said first gap (220) is structured so as to effectively inhibit the flow of heat to said first flap (114) of said longitudinal male element (106) when a first panel member of the flexible package is sealed to an outer surface portion (213) of said first end portion (212) of said tamper evident diaphragm (200), a plurality of first vertically spaced temperature sensitive ribs (202) configured along the length of said outer surface portion (213) of said first end portion (212) of said tamper evident diaphragm (200) for sealing the first panel member of the flexible package to said tamper evident diaphragm (200), wherein said first vertically spaced temperature sensitive ribs (202) are structured to melt when heat is applied through the first panel member, and wherein said vertically spaced first sealing portions (216,218) are disposed at vertical elevations upon said first end portion (212) of said tamper evident diaphragm (200) so as to be interposed between consecutive ones of said plurality of first vertically spaced temperature sensitive ribs (202) disposed upon said first end portion (212) of said tamper evident diaphragm (200) and are structured so as to remain intact and maintain said first gap (220) after said first temperature sensitive ribs (202) melt; and a second end portion (214) adapted to be sealed with an outer surface portion (117) of said second flap (116) of said female element (108) of said zipper at two vertically spaced sealing areas by means of two vertically spaced second sealing portions (222,224) so as to provide a second gap (226) therebetween, said two vertically spaced second sealing portions (222,224) being separate and distinct from said second end portion (214) of said tamper evident diaphragm (200) and said second flap of said female element (108) and extending transversely across said second gap (226) from inner surface portions (223,225) of said second end portion (214) of said tamper evident diaphragm (200) to outer surface portions (117,119) of said second flap (116) of said female element (108), wherein said second gap (226) is structured so as to effectively inhibit the flow of heat to said second flap (116) of said female element (108) when a second panel member of the flexible package is sealed to an outer surface portion (215) of said second end portion (214) of said tamper evident diaphragm (200), and a plurality of vertically spaced second temperature sensitive ribs (202) configured along the length of said outer surface portion (215) of said second end portion (214) of said tamper evident diaphragm (200) for sealing the second panel member of the flexible package to said tamper evident diaphragm (200), wherein said plurality of vertically spaced second temperature sensitive ribs (202) are structured to melt when heat is applied through the second panel member, and wherein said vertically spaced second sealing portions (222,224) are disposed at vertical elevations upon said second end portion (214) of said tamper evident diaphragm (200) so as to be interposed between consecutive ones of said plurality of second vertically spaced temperature sensitive ribs (202) and are structured to remain intact and maintain said second gap (226) after said second temperature sensitive ribs (202) melt.

8. The method for forming the tamper evident structure as claimed in claim 7, wherein sealing the slider-zipper assembly with the tamper evident diaphragm comprises at least one of a heat technique, an ultrasonic sealing technique, a high frequency technique and a hot melt sealing technique.

9. The method for forming the tamper evident structure as claimed in claim 7, further comprising forming a plurality of projections along the length on the inner surface of the tamper evident diaphragm, the plurality of projections is capable of maintaining a separation between the folded inner surfaces of the tamper evident diaphragm.

10. The method for forming the tamper evident structure as claimed in claim 7, wherein a pressure sensitive weak line configured centrally along the length of the tamper evident diaphragm for tearing thereto to access the flexible package to which the tamper evident structure is configured.

11. A tamper evident flexible package comprising:

a pair of opposite panels coupled to configure a pocket having three closed sides and a top open side; and a tamper evident structure sealed to at least one panel of the pair of opposite panels proximate to the top open side, wherein the tamper evident structure comprises a slider-zipper assembly having a slider adapted to engage with a zipper to close and open the zipper, wherein the zipper comprises a longitudinal male element (106), and a longitudinal female element (108) engageable with said longitudinal male element (106), a first flap (114) extending longitudinally, downwardly from, and along the length of said longitudinal male element (106), and a second flap (116) extending longitudinally, downwardly from, and along the length of said longitudinal female element (108); and a tamper evident diaphragm (200) having a first end portion (212) adapted to be sealed with an outer surface portion of said first flap (114) of said longitudinal male element (106) of said zipper at two vertically spaced sealing areas by means of two vertically spaced first sealing portions (216,218) so as to provide a first gap (220) therebetween, said two vertically spaced first sealing portions (216,218) being separate and distinct from said first end portion (212) of said tamper evident diaphragm (200) and said first flap (114) of said male element (106) and extending transversely across said first gap (220) from inner surface portions (217, 219) of said first end portion (212) of said tamper evident diaphragm (200) to outer surface portions (113,115) of said first flap (114) of said longitudinal male element (106), wherein said first gap (220) is structured so as to effectively inhibit the flow of heat to said first flap (114) of said longitudinal male element (106) when a first panel member of the flexible package is sealed to an outer surface portion (213) of said first end portion (212) of said tamper evident diaphragm (200), a plurality of first vertically spaced temperature sensitive ribs (202) configured along the length of said outer surface portion (213) of said first end portion (212) of said tamper evident diaphragm (200) for sealing the first panel member of the flexible package to said tamper evident diaphragm (200), wherein said first vertically spaced temperature sensitive ribs (202) are structured to melt when heat is applied through the first panel member, and wherein said vertically spaced first sealing portions (216,218) are disposed at vertical elevations upon said first end portion (212) of said tamper evident diaphragm (200) so as to be interposed between consecutive ones of said plurality of first vertically spaced temperature sensitive ribs (202) disposed upon said first end portion (212) of said tamper evident diaphragm (200) and are structured so as to remain intact and maintain said first gap (220) after said first temperature sensitive ribs (202) melt; and a second end portion (214) adapted to be sealed with an outer surface portion (117) of said second flap (116) of said female element (108) of said zipper at two vertically spaced sealing areas by means of two vertically spaced second sealing portions (222,224) so as to provide a second gap (226) therebetween, said two vertically spaced second sealing portions (222, 224) being separate and distinct from said second end portion (214) of said tamper evident diaphragm (200) and said second flap of said female element (108) and extending transversely across said second gap (226) from inner surface portions (223,225) of said second end portion (214) of said tamper evident diaphragm (200) to outer surface portions (117,119) of said second flap (116) of said female element (108), wherein said second gap (226) is structured so as to effectively inhibit the flow of heat to said second flap (116) of said female element (108) when a second panel member of the flexible package is sealed to an outer surface portion (215) of said second end portion (214) of said tamper evident diaphragm (200), and a plurality of vertically spaced second temperature sensitive ribs (202) configured along the length of said outer surface portion (215) of said second end portion (214) of said tamper evident diaphragm (200) for sealing the second panel member of the flexible package to said tamper evident diaphragm (200), wherein said plurality of vertically spaced second temperature sensitive ribs (202) are structured to melt when heat is applied through the second panel member, and wherein said vertically spaced second sealing portions (222,224) are disposed at vertical elevations upon said second end portion (214) of said tamper evident diaphragm (200) so as to be interposed between consecutive ones of said plurality of second vertically spaced temperature sensitive ribs (202) and are structured to remain intact and maintain said second gap (226) after said second temperature sensitive ribs (202) melt.

12. The flexible package as claimed in claim 11, wherein the slider-zipper assembly and the tamper evident diaphragm are sealed to each other by at least one of a heat sealing technique, an ultrasonic sealing technique, a high frequency sealing technique and a hot melt sealing technique.

13. The flexible package as claimed in claim 11, wherein the taper evident diaphragm further comprises a plurality of projections configured along the length on the inner surface thereof, wherein the plurality of projections is capable of maintaining a separation between the folded inner surface of the tamper evident diaphragm, thereby preventing sealing thereof to each other while sealing the tamper evident structure to the at least one panel of the pair of opposite panels proximate to the top opened pocket.

14. The flexible package as claimed in claim 11, wherein a pressure sensitive weak line configured centrally along the length of the tamper evident diaphragm for tearing thereto to access the flexible package.

* * * * *